US005263723A

United States Patent [19]

Pearson et al.

[11] Patent Number: 5,263,723

[45] Date of Patent: * Nov. 23, 1993

[54] INTERACTIVE CONTEST SYSTEM

[75] Inventors: Timothy R. Pearson; William W. Junkin, both of Laguna Beach, Calif.

[73] Assignee: Wakeman & deForrest Corporation, Irvine, Calif.

[ * ] Notice: The portion of the term of this patent subsequent to May 28, 2008 has been disclaimed.

[21] Appl. No.: 691,283

[22] Filed: Apr. 25, 1991

Related U.S. Application Data

[63] Continuation of Ser. No. 428,866, Oct. 27, 1989, Pat. No. 5,018,736.

[51] Int. Cl.[5] ..... A63F 9/00; H04M 11/00

[52] U.S. Cl. ..... 273/439; 273/85 R; 273/88; 273/94; 379/92; 379/93; 379/95

[58] Field of Search ..... 273/434, 439, 85 R, 273/85 G, 88, 94, DIG. 28, 138 A, 143 R, 237; 364/410, 411, 412, 400, 401, 408; 379/90, 91, 92, 93, 95, 97, 88, 87

[56] References Cited

U.S. PATENT DOCUMENTS

| | | | |
|---|---|---|---|
| 4,626,623 | 12/1986 | LaHaye | 379/95 |
| 4,845,739 | 7/1989 | Katz | 379/92 |
| 4,918,603 | 4/1990 | Hughes et al. | 273/94 |
| 5,018,736 | 5/1991 | Pearson et al. | 273/439 |

FOREIGN PATENT DOCUMENTS

| | | | |
|---|---|---|---|
| 8700375 | 1/1987 | World Int. Prop. O. | 379/93 |

OTHER PUBLICATIONS

Mase, Mike, ("Your Number Please?) Gains a New Meaning", *Telephony*, Oct. 13, 1986 pp. 94, 96.

Smith et al, "Alphabetic Data Entry via the Touch--Tone Pad", Human Factors, Apr. 1971 pp. 189-190.

All Pro Year Book-1987, Published by All Pro Publishing, Van Nuys, CA pp. 1-9.

*Primary Examiner*—Jessica J. Harrison

*Attorney, Agent, or Firm*—Lowe, Price, LeBlanc & Becker

[57] ABSTRACT

An interactive contest system is provided which permits competition among a plurality of remote participants. The system includes a central controller, storage devices for storing a Contest Roster from which each participant selects a team roster, a plurality of Touch-Tone TM telephones linked to the controller, and a publication such as a newspaper distributed to all participants. Each participant's team roster is evaluated on a periodic basis according to a formula for calculating each member's score employing a database of variable performance statistics which reflect the roster members' actual performances. Team roster totals are compared for discrete periods of competition to determine which participants have accumulated the highest score.

11 Claims, 8 Drawing Sheets

INTERACTIVE CONTEST SYSTEM

This application is a continuation of application Ser. No. 07/428,866 filed Oct. 27, 1989, now U.S. Pat. No. 5,018,736.

BACKGROUND OF THE INVENTION

This invention relates to contests, and more particularly to an interactive sports contest system which allows remotely located participants to compete by optimizing the performance of their team rosters through the selection and trading of players.

Professional or college sports support a broad range of secondary competitions ranging from betting on the outcome of particular games to betting on a particular performance of a given player. Contests based upon player performances include the fantasy sports leagues such as fantasy baseball and fantasy football. In the fantasy sports leagues, sometimes called "rotisserie leagues", participants assume the position of an owner of an imaginary team. Prior to the beginning of a professional sport season, the owners conduct a "draft" of professional athletes to fill the roster of their team. As the imaginary teams usually employ the actual player positions in the sport, spots on the rosters are filled with players who play the particular position.

The drafting of players may take a variety of forms, including a bidding draft and a rotation draft. In the bidding draft, each owner is initially provided with a specific bankroll of bidding units which may be used to bid against other owners in an attempt to obtain a specific player. Alternatively, in the rotation draft, the owners determine an order of selection, and proceed through a number of rounds to fill out the rosters. However, under either draft structure, once a player has been drafted by an owner, that player is no longer available to other owners. Therefore, each owner must reprioritize the available players throughout the draft process. As in the professional sports leagues, the owners may trade players during the contest. Typically, after the draft, and throughout the season, the trades are made between owners, and between the players not selected in the initial draft. The teams in a fantasy sports league typically accumulate a "won-lost" record by competing head to head against each of the other teams in the league. In a "game" between two teams, the team whose players performed better in the previous week is declared the winner. Typically, each team competes on the cumulative statistics of the drafted players.

Other contests based upon sporting events have included officiating a given contest, as disclosed in the patent to Tovar (U.S. Pat. No. 4,722,526). Tovar discloses a contest based upon the signaling of infractions of the rules during a live sporting event. The infractions as perceived by the participants are compared to the actual calls made by an official, or referee of the game. The first participant to signal the occurrence of an infraction, that the official also signals, is awarded multiple points, while subsequent participants to signal the infraction are awarded a lesser number of points. The individual scores of the participants are accumulated, and the one having the highest score at the end of the sporting event is declared the winner.

Another game which may be played in conjunction with a sporting event is disclosed in Fascenda (U.S. Pat. No. 4,592,546). Fascenda discloses a game of skill playable by several remote participants in conjunction with a live sporting event, such as a televised football game. The Fascenda disclosure requires participants to predict a future variable of the live sporting event, wherein the participant's prediction is stored over the life of the live event. Subsequent to the live event, the participant's accumulated predictions are processed and compared to the actual occurrences of the game. The winner is the viewer most accurately predicting the events throughout the live sporting event.

These previous contests are really limited to participants that have an in-depth understanding of the relevant sport. In addition, the drafting of the fantasy sports leagues does not permit interactive competition by a large number of participants. Also, some interactive systems require the remote participants to use specialized equipment such as a transmitter/receiver used to interact while the sporting event is being played. When special equipment is required, the availability of the contest is further limited. In addition, the draft in the fantasy sports leagues requires at least one collective meeting of all the participants during the course of the contest. The necessity of these meetings makes it difficult for remote participants to compete.

Therefore, a need exists for a sports contest which provides interactive competition among a plurality of remote participants. There is a need for a contest in which participation does not require specialized equipment in order to enter or compete. In addition, a need exists for an interactive competition which does not hinge upon the simultaneous monitoring of a specific live event. There is also a need for an interactive competition which does not require a slavish time commitment by the participants to a predetermined professional sports schedule. A further need exists for an interactive sports contest which provides a periodic incentive for the application of skill and foresight.

BRIEF DESCRIPTION OF A PREFERRED EMBODIMENT OF THE INVENTION

An interactive sports contest system is disclosed. The contest provides an interactive competition among a plurality of remote participants. The interactive sports contest employs a central controller; a plurality of data entry terminals; a data link; a contest roster; a statistical data base; a team database; a formula for calculating each contest player's score as a function of the athlete's statistics, and a publication, which is communicated to the participants such as a radio or television broadcast, point of sale display, or any printed publications such as a newspaper, which includes a system access code.

The contest is based upon a score generated by each participant's selected team roster. Each participant's team roster is composed of a number of athletes as selected by the participant from the "Contest Roster". The Contest Roster is a list prepared for the contest and advantageously consists of substantially all of the players from actual contest lineups. However, the Contest Roster does not necessarily include all of the athletes of the sport on which the contest is based. Each team roster is scored as a function of the actual performances of the individual players on the team during the term of the contest. The score for each athlete on the Contest Roster is determined by use of a predetermined formula. The competition resides in the ability of each participant to select and maintain a team roster which will generate the most points according to the player score calculation.

The central controller is employed to provide the necessary data handling and participant interface so as to promote competition among the participants. Preferably, the central controller includes or has access to: the Contest Roster; the team roster of each participant as stored in the team database; and the statistical database including the score for each player in the Contest Roster. Preferably, the controller provides a current evaluation of the team roster of each participant, in addition to all players on the Contest Roster. A contest player is advantageously evaluated on a daily or weekly basis as a function of that player's statistics so that each player's performance may take the form of a numerical quantity. This quantity is then added to the week-to-date and contest-to-date scores of each participant. The cumulative week-to-date and contest-to-date scores are then made available to each participant at each remote location through the data entry terminals. A participant's team roster performance is determined by summing the individual scores of all the players on that participant's team roster. The team roster total score is also made available to remote participants through the data entry terminals. In the preferred embodiment, the central controller may be accessed by a plurality of remote data entry terminals. Data exchange between the central controller and the data entry terminals occurs through the data link.

The contest for a particular sport requires each participant to select a team roster from the Contest Roster of athletes who participate in the particular sport. The athletes listed on the Contest Roster may play, for example, on the college or professional level. Preferably, a listing of the players included within the Contest Roster is readily available to each remote participant and includes substantially all of the athletes associated with the sport. Preferably each player on the Contest Roster is identified by a code for purposes of communication with the central controller. Each player on the Contest Roster is available to be employed on the roster of any participant. Since each participant may select any player on the Contest Roster there is no bidding, or competitive drafting among participants to obtain certain players from the Contest Roster. Therefore, a player on the Contest Roster may appear on a plurality of participant team rosters.

The selected team roster is entered into the central controller from the data entry terminal. Preferably, the code identifying a selected player is entered into the central controller as the participant creates or modifies the team roster.

Preferably, the statistics reflecting the actual performances of each player are available to the participants (for example, through some form of publication, such as a daily newspaper), as well as entered and stored in the statistical database. Each member of the Contest Roster is evaluated or scored according to the player score calculation. The player score calculation provides quantification of those characteristics in the statistical database which are associated with a given player. The scores generated by each member of a participant's team roster are added together to provide a team roster total. Competition among the participants is based upon a comparison of the team roster totals for a given time period. A participant wins the competition by maintaining the team roster which generates the most points during the time period.

Preferably, the contest extends throughout the course of the professional sports season. However, the professional season may be segmented into a finite number of discrete periods over which the score of each team roster is monitored. In the preferred embodiment the discrete periods are weekly. Therefore, in addition to a cumulative overall season total, participants may compete for the highest total within each discrete period of the season.

The weekly and cumulative overall season total scores may be publicized in some form of mass media such as a daily newspaper. In addition to publishing scores, the publication media, such as a newspaper, for example, may include rules for the contest as well as instructions on how to participate. In this context, the publication is included as a part of the overall contest system.

In order for a participant to maximize, or optimize, the performance of their team roster, the participant may trade players between their team roster and the Contest Roster. As discussed above, the Contest Roster contains a listing of all the available players in the contest. Poor performances, injuries or anticipated future performances of the players provides the continual need to reevaluate the performance of the players on a participant's team roster. As each participant knows the player score calculations for evaluating the players, the characteristics of each player as reflected by the accumulated statistics, and the schedule for the actual games to be played, each participant may continuously evaluate the value of each member of their team roster so as to determine whether a trade should be made.

The interactive sports contest thereby provides competition among a plurality of participants by affording common available players, and known statistics which are used to rank a participant's team roster according to a known formula for calculating player scores.

Although the preferred embodiment is described in terms of an interactive baseball contest, the interactive sports contest may be based upon other sports such as basketball, football, hockey, soccer, golf, rugby, cricket, tennis or horse racing, where the players' performances may be periodically presented in the form of selected statistics.

Further, some of the features disclosed may well have applicability in other interactive systems which do not involve sports or contests. For example, the system of the present invention may be implemented as a stock exchange contest. In such a contest certain stocks are advantageously included as members or elements of the data register. Each participant can be given a certain number of imaginary dollars with which to purchase a subset of stocks. The participant with the highest return on their investment for a given period would be the contest winner. Other features of this embodiment such as daily score update, and participant interaction (for example, trading or buying stocks) through the data entry terminal would be implemented in a manner simliar to the interactive sports contest.

DETAILED DESCRIPTION OF A PREFERRED EMBODIMENT

The disclosed interactive contest system includes an apparatus for accommodating the interactive sports contest and a method for conducting the interactive sports contest. Of course it is also possible that the apparatus of the interactive contest system, and certain elements of the method outlined for conducting an interactive sports contest may also be applied to an interactive stock investment contest or the like.

Apparatus of the Interactive Contest System

Figure 1:
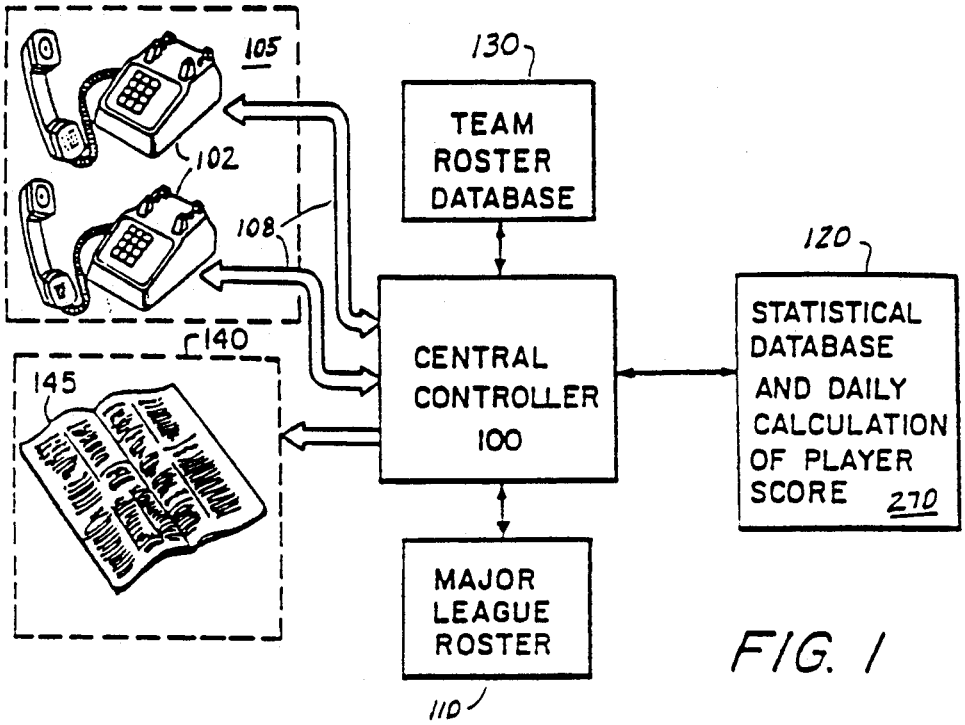
FIG. 1 depicts a block diagram of a preferred embodiment of the present invention.

As illustrated in FIG. 1, the interactive contest system includes a central controller 100; data entry terminals 105; a data link 108; a Contest Roster 110; a statistical database 120; a team roster database 130; and a player score computer 270 contained within statistical database 120 for calculating a score for each player as a function of the individual player's actual performance. Alternatively, for example, the player score computer 270 may be used to update the prices of certain stocks on the stock exchange.

Central Controller

The central controller 100 includes or has access to a Contest Roster 110 which advantageously includes a list of athletes which can be relied upon in the contest. The central controller 100 also includes or has access to the team roster database 130 which includes the team rosters as selected and entered by each of the participants, including the identifying information which associates a team roster to the corresponding participant. The central controller 100 also includes or has access to the statistical database 120 which includes the recent statistics of each player on the Contest Roster 110. The central controller 100 also includes or has access to the player score for each player on the Contest Roster 110 as based upon the associated statistical database 120. Preferably, the central controller 100 is adapted to recognize and distinguish machine recognizable signals, such as transmitted by a conventional Touch-Tone TM telephone 102.

Figure 2:
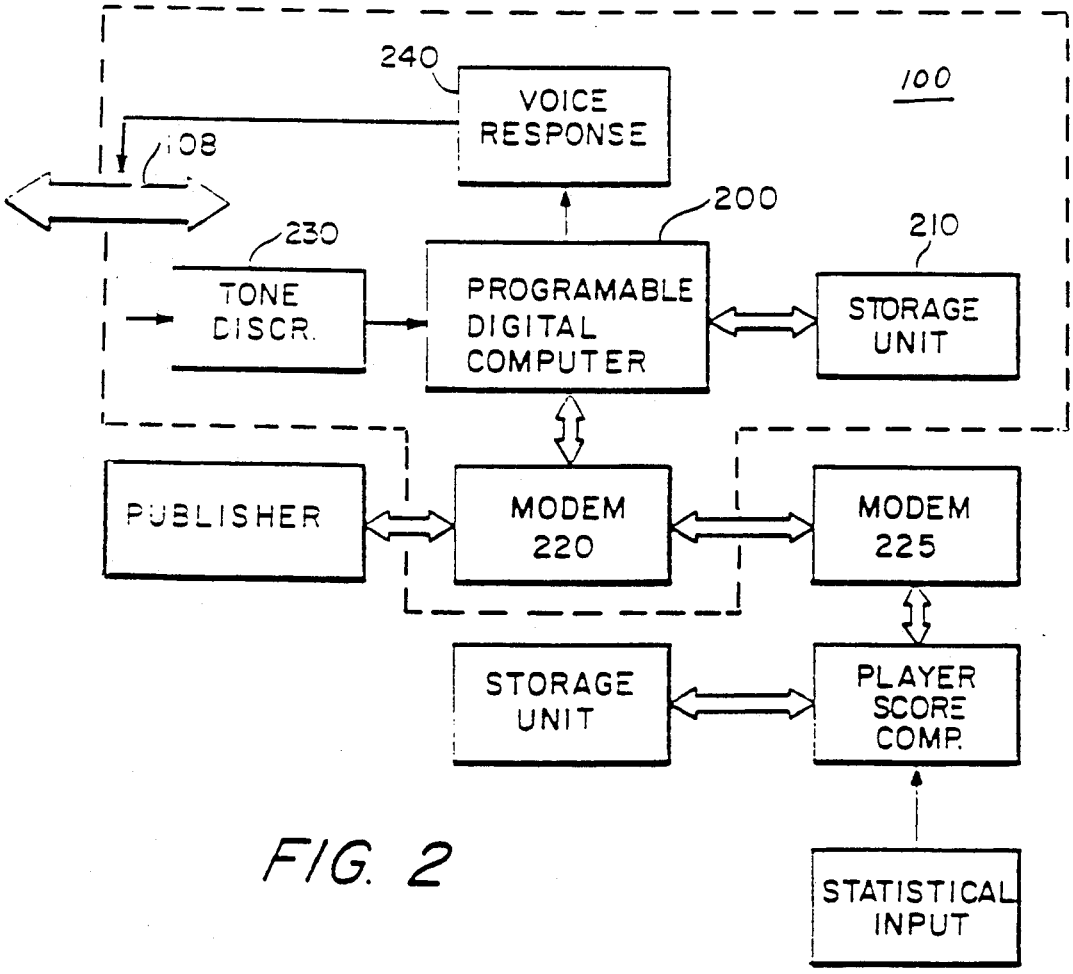
FIG. 2 depicts a block diagram of the components incorporated into the central controller of FIG. 1.

FIG. 2 depicts a block diagram of the central controller 100, as well as some external components. As illustrated in FIG. 2, the central controller 100 incorporates a programable digital computer 200, a memory storage unit 210, a modem 220, a tone discriminator 230, and a voice response system 240. The apparatus for playing back the recorded human voice over the data link 108 to the participant's terminal (preferably a Touch-Tone TM Telephone) could be any well known recording and play back system including magnetic tape, magnetic disc, or optical disc. The programable digital computer 200 may be implemented by any of a plurality of commercially available computer systems. The processing and storage capacity needed depends upon the anticipated number of contestants. The memory storage unit 210 may advantageously be any one of a plurality of commercially available devices, such as a floppy or hard disk, or any combination thereof. The modem 220 can likewise be any conventional modem device for use with a digital computer. The modem 220 communicates signals from two external sources, the player score computer 270 through modem 225, and the publisher 250. Information may be exchanged with the publisher 250 via the modem link 222 or the statistical database 120. Alternatively or in addition to modem communication the central controller 100 may transmit printed information to the publisher 250 via a facsimile telecopier.

Figure 10:
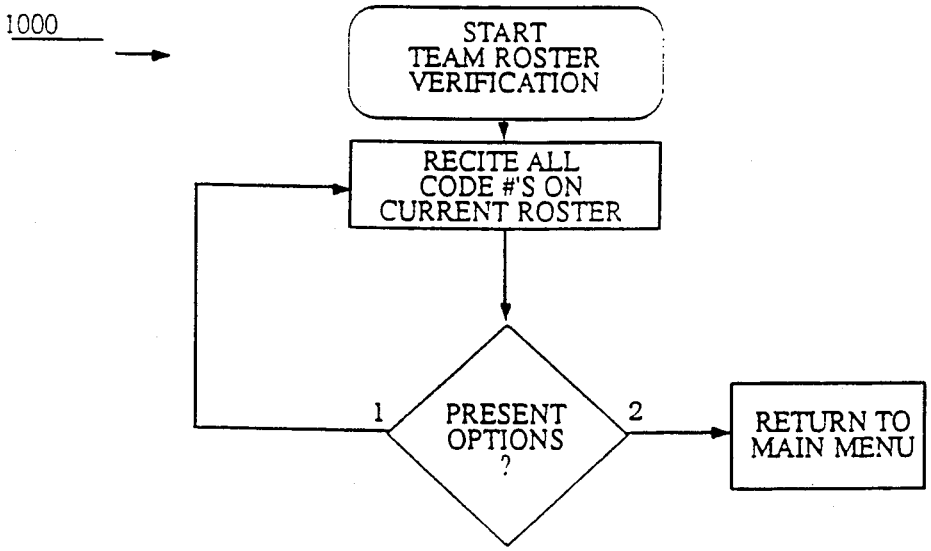
FIG. 10 illustrates the specifics of the sequence of interaction between the participant and the game system to be followed during the team roster verification subroutine of FIG. 6.

As shown in FIG. 10 the statistical database 120 advantageously includes a player score computer 270, a storage unit 275, and a means of statistical input 278. The player score computer 270 has access to both the storage unit 275, and the statistical input 278. The player score computer 270 also has within its memory the formula that is used to convert the selected player statistics into a numerical performance value for each player. The player score computer 270 periodically computes the numerical performance value for each individual player.

The statistical database 120 is separate from the central controller 100 so that it can be placed in the most convenient possible location for the collection and processing of the necessary statistics.

While this configuration has been found to be advantageous, the functions provided by the statistical database 120, including the calculation of the player score, could easily be combined with those performed by the central controller 100 so that only one computer system is required.

Referring to FIGS. 1 and 2, the data entry terminals 105 are advantageously Touch-Tone TM telephones 102, and are connected to a tone discriminator 230 via data link 108. The transmitted signals are preferably machine recognizable, such as can be deciphered by the tone discriminator 230. The tone discriminator 230 converts the transmitted data from audible frequencies to digital signals. These digital signals are easily recognized by the programable digital computer 200.

Once the transmitted data has been processed, the programable digital computer 200 sends the appropriate output to the voice response system 240. The output of the programable digital computer 200 may, for example, prompt one of a number of pre-recorded messages to be played, so that the system may respond in a human voice. This human voice is then transmitted back to the participant's data entry terminal 105 (e.g., a Touch-Tone TM telephone 102) via the data link 108. Voice response systems using Touch-Tone TM telephones as the data input and receiving terminal are well known in the art and need not be described in detail here.

The human voice may advantageously be produced by any conventional means. One such means of producing a simulated human voice is to incorporate a number of prerecorded tape messages into the interactive game system. Each input by a participant would trigger the central controller 100 to provide an appropriate voice recording which would be relayed over the data link 108 to the participant. Those messages which are likely to occur several times over the course of the interaction between the participant and the game system, may be synthesized by a conventional voice synthesizer. Such messages may include individual numbers such as "one", "two", etc., which are likely to be repeated several times over the course of a typical interaction.

Data Entry Terminals

As shown in FIG. 1, the data entry terminals 105 provide an interface between each participant and the central controller 100. Preferably, the data entry terminals 105 are remotely located from the central controller 100 at a location convenient to the individual participant. The data entry terminals 105 advantageously comprise conventional Touch-Tone TM telephone instruments 102 each having a keypad which produces machine-recognizable signals. Although the present system is designed for Touch-Tone TM telephone 102 input with this response, the same principle could be applied to communication between a personal computer and the central controller 100. Alternatively, the contest system could be set up to accommodate both types of data entry terminals. In the preferred embodiment a conventional Touch-Tone TM telephone 102 instrument is employed as the remote data entry and receiving terminal for contest participants.

Data Link

The data link 108, as employed in the interactive sports contest, advantageously includes conventional telephone lines connecting the central controller 100 to the data entry terminal 105. The data link 108 provides data and verbal communication between two remote locations such as the central controller 100 and the data entry terminals 105. Alternatively, the data link 108 may include microwave or satellite transmission systems. The data link 108 thereby provides a communication path for data to be exchanged between the central controller 100 and the remote data entry terminal 105.

The Contest Roster

The Contest Roster 110 includes a list of athletes, or players who participate in the relevant sport (of course, the Contest Roster 110 may alternatively include a list of stocks or commodities). Preferably, the Contest Roster 110 lists or includes all of the actual players in the professional league (or alternatively the players in a particular college conference or division) of the sport associated with the contest. Since all of the players from a particular league of the sport associated with the contest are included on the Contest Roster 110 each players from that league on the Contest Roster 110. In addition to personal favorites, the Contest Roster 110 includes those players likely to have an impact on the sport during the season. It should be noted, however, that the number of players included on the Contest Roster 110 may be chosen according to specific considerations of the relevant sport and will not necessarily include all the actual athletes who play in the professional or college leagues of the sport in question.

For sports such as basketball or hockey, wherein each position of the team is highly significant, each professional team typically has more than one player for each position in real life. In an attempt to faithfully simulate such real life situations within the contest system, the Contest Roster 110 may include more than one player from each professional team for each position. It should also be noted that in some sports, similar positions may be classified within a single category. For example, in real life baseball, the right fielder, center fielder and left fielder may be treated collectively as outfielders. Correspondingly, the contest system may incorporate a Contest Roster 110 which categorizes all players who play right field, left field, and center field in real life, collectively as outfielders. In the preferred embodiment of the contest system, a participant may choose three outfielders from the Contest Roster 110 even if they all, for example, play center field in real life.

Also, some positions in real life within a given sport may inherently generate very few of the statistics which are generally used to gauge a typical player's performance. Such positions need not be included as a category within the Contest Roster 110. For example, in real life football, the guard and tackle positions generate relatively few distinguishing characteristic statistics such as yards gained or touchdowns. Therefore, the contest roster 110 may not include these positions or players. However, even if a position is not included as a category on the Contest Roster 110, a particular athlete playing that position may still be included on the Contest Roster 110 if that particular player is likely to generate statistics accounted for in the player score calculation.

Therefore, the positions and players listed on the Contest Roster 110 may represent an accommodation of the characteristics of the sport, as typically monitored by the sports industry. In other words, since a player's performance is typically monitored in relation to the statistics which the player generates, it is probable that those players who are likely to generate statistics that are used as indicators throughout the sports industry will be selected to appear in the contest system's Contest Roster 110. The statistics which are recognized throughout the industry as indicators of a player's performance, are advantageously included as factors when calculating the player score.

Preferably, each player on the Contest Roster 110 is associated with a specific code uniquely identifying that specific player with respect to all other players in the Contest Roster 110. In the preferred embodiment of the interactive baseball contest, each player on the Contest Roster 110 is represented by a four-digit numerical code. The numerical code is used to identify a specific athlete during communications between the participant and the central controller 100.

Preferably, the position to which each athlete is assigned in the contest is encoded within the code number. For example, all first baseman may be assigned code numbers beginning with the number "1", all second baseman may be assigned code numbers beginning with the number "2", and so on.

In addition to the identification code associated with each player on the Contest Roster 110, a quantitative indicator of each players performance (cumulative over a season, or in weekly increments) may be advantageously included in the Contest Roster 110. In a preferred embodiment, the quantitative indicator of a player's performance is determined as a function of that player's real life statistics. Each player's real life statistics are available through the statistical database 120 (the statistical database 120 will be discussed in further detail below). The real life statistics of a particular player are converted into a quantitative (i.e., numerical) score by means of the game system formula.

In a preferred embodiment, a list of the players in the Contest Roster 110, along with each player's code number, is distributed in a newspaper 145 or any other form of mass media, or publication, such as a broadcast or point of sale, which is readily available to the participants.

Statistical Database

The statistical database 120 includes a list of selected statistics for each member of the Contest Roster 110. Preferably, the statistical database 120 includes the selected statistics corresponding to the actual performances of each of the athletes (or alternatively each of the stocks) listed in the Contest Roster 110. These selected statistics are advantageously updated on a daily basis.

Although any of a wide variety of statistics may be employed, it is preferable that the chosen statistics represent the most popular aspects of the sport which are monitored throughout the season.

In a preferred embodiment of the present invention, the real life statistics of each athlete listed on the Contest Roster are accumulated and input into the player score computer 270, through the statistical input terminal 278 at the end of each day. The statistics are stored in the storage unit 275 in connection with each athlete on the Contest Roster 110. In the preferred embodiment, the real life statistics of each player are evaluated by the player score computer 270 according to the player score formula so that a quantitative performance indicator score for each player is obtained on a daily basis. The quantitative performance indicator scores are then input to the Contest Roster 110 early in the morning of the next day, via communication link 221, at the corresponding player address, where the value is stored for later reference.

Advantageously, the performance scores for the players are downloaded to the controller computer 200 in a conventional manner beginning some time early each morning when participants are not likely want to interact with the system, for example, at 2AM each morning. The downloading and internal processing may continue for several hours until a specified time; advantageously 6AM that same morning. During the downloading and internal processing period the system will not be available for interaction with any participants. Of course the downloading of the player scores could be accomplished at any time after all games have been completed for the contest period, advantageously each day, and need not be restricted to the early morning hours. Also, the duration that the central controller 100 is processing the data input from the statistical database 130, and is thereby not available to interact with participants, is dependent upon the volume of information that must be processed, and the capacity of the controller computer 200. For example, if a large number of participants are involved in the interactive contest, or if the controller computer 200 is small, the amount of time that the system is unavailable to interact with the participants will be greater than if there are few participants, and the controller computer 200 has a high storage and processing capacity. The internal processing may advantageously consist of distributing and assigning performance scores to each player in the team roster database, and tabulating all team roster score totals. The results are then stored in the controller storage unit 210.

In the interactive baseball contest, the statistical database 120 advantageously includes field player characteristics such as Runs Batted In (RBI); Hits, specifically singles, doubles, triples and home runs; Runs Scored; Stolen Bases; and Errors. The pitcher statistics advantageously includes Wins, Strikeouts, Losses, and Earned Runs.

However, statistics which are not currently published in a typical sports page of the newspaper 145 may also be included in the statistical database 120. It is preferable that the selected statistics of the statistical database 120 be regularly distributed in the newspaper 145 and/or other forms of publication such as radio or television broadcasts which are readily available to the participants.

Team Roster Database

The team roster database 130 includes a list or array of team rosters as entered by each participant. Each participant may be asked to identify himself or herself by some means, such as a home telephone number or a social security number or both. The participant is then asked to choose a team roster of members (for example athletes or stocks) from the Contest Roster 110. The team roster is then converted into digital information and stored as an individual file in the team roster database 130. The Contest Roster and all the team rosters are advantageously stored in the controller storage unit 210. Each file is addressed or accessed in a conventional manner using the information disclosed by the participant, advantageously, the participant's social security number, as an address code.

Also included within each participant's team roster file are the cumulative weekly team score (as of the previous day), and the cumulative contest-to-date team score (as of the previous day). In addition to these scores, each team roster in the team roster database includes the answers to the three tie-breaker questions as entered by each participant.

Once a participant has selected a team roster, a person may only access the selected team roster using the identification information provided by the participant. A participant may want to access his or her selected team roster in order to evaluate the performance of the entire team, to verify the players on the current team roster, or to trade a player from the team roster.

Calculation of Individual Player Score and Team Score

The contest system provides for the evaluation of the players according to selected real life statistics as represented in the statistical database 120. In a preferred embodiment of the present invention, the calculation of the individual player scores is done by the player score computer 270 within the statistical database 120. The player score calculation includes a plurality of factors which correspond to the characteristics found in the statistical database 120. The score calculation allows for the evaluation of each athlete on the Contest Roster 110 according to the statistics generated by that player. For instance, an athlete with a particular score would be evaluated as doing better than another athlete who had a lower score. In this way a quantitative comparison can be made between athletes on the Contest Roster 110.

The player score calculation may provide for the weighting of certain statistics depending on the importance, difficulty or occurrence rate of each statistic. In addition, the player score calculation may be uniquely tailored to accommodate a particular sport. Preferably, the formula for calculating the player score is available to all participants so that each participant may conduct an independent evaluation of their team roster with respect to the players on the main Contest Roster 110.

In the preferred embodiment of the interactive baseball contest, the player score for field players, reserve players and designated hitters provides that the points for each player is calculated as follows: Runs (R) +Hits (1, 2, 3, 4)+RBI's (runs batted in)+SB (stolen bases) —E (errors). Therefore, a player hitting 3 hits (1 home run, 2 singles, 0 doubles, and 0 triples), stealing 1 base, scoring 3 runs, batting in 3 runs and committing no errors during a period of competition, one game for example, earns: 3 runs scored (1 home run and 2 other runs scored)+6 hits (1×4 for home runs+0×3 for triples+0×2 for doubles+2×1 for singles)+3 RBI's+1 stolen base −0 errors=13.

For pitchers, points are accumulated according to the player score as follows: (wins)×5+(SO) (strike outs)×3−(losses)×2−ER (earned runs). Therefore, a pitcher having 1 win, 9 strikeouts, 0 losses and giving up 2 earned runs in a period of competition, one game for example, earns 5 (1×5) wins+27 (9×3) strikeouts−0 losses 2 earned runs=30 points. In the preferred embodiment a pitcher earns no points for a good hitting performance.

Another example of a formula which uniquely weights an athlete's statistics so that the player score reflects the athlete's performance, may be outlined in the following manner. For field and utility players: Runs(R)+[Hits(1,2,3,4)/2]+Runs Batted In (RBI)+-Stolen Bases(SB) −Errors(E)=player score. For pitchers: Wins(W×5)+Strikeouts(SO×1)−Loss(L×3-)−Earned Runs(ER)=player score. According to this formula, the field player in the previous example would receive 3 runs scored +3 hits [(1×4 +0×3+0×2+2×1)/2]+3 RBI's+1 Stolen Base−0 errors =10 points. The pitcher in the previos example would accumulate 5 (1×5) wins+9 (9×1) strikeouts −0 (0×3) losses −2 (2×1) earned runs=12 points.

In still another formula which advantageously is implemented in a contest for basketball participants generate points as follows: Minutes Played (MP/15)+ Field Goals (FG×2 failed attempts)+Three Point Goals (3PFG×3 −failed attempts)+Free Throws (FT×1−failed attempts)+Rebounds(R)+Assists(A)+Wins(W×2)−Technical Fouls (T×5) Personal Fouls (PF×3)−Losses(L×1)=Player Score. For example, a player having played 40 minutes, making 8 and missing 6 field goals, making 1 and missing 1 three point goal, making 4 and missing 1 free throw, getting 8 rebounds and 4 assists, winning 1 game and losing no games, having 3 personal fouls and no technical fouls would recieve: 3 (40/15 rounded to the nearest integer) minutes played+10 (8×2−6) field goals+2 (1×3−1) three point goals +3 (4×1−1) free throws+8 rebounds+4 assists+2 (1×2) wins−0 (0×5) technical fouls−9 (3×3) personal fouls−0 (0×1) losses =23 points.

It should be noted that other formulas which uniquely weight an athlete's statistics so that the player score reflects the athlete's performance, may be implemented in accordance with the present invention.

Objectives in the Interactive Contest System

The primary objective of the interactive sports contest is for each participant to optimize the total points generated by their team roster.

The contest is advantageously conducted so that competition is based upon team roster scores generated for the season, thereby encouraging participants to compete throughout the entire duration of the contest. Competition throughout the duration of the season may advantageously be fostered by basing the competition on the cumulative score for discrete weekly periods. However, as a single goal may not maximize participation, each of the discrete periods of the season may be treated as an individual contest, thereby providing a larger number of opportunities for interactive competition.

Competition among remote participants may also be advantageously fostered by providing prizes, both weekly and for the overall contest, for those participants whose team rosters generate the highest cumulative score totals. Prizes may also be awarded to participants at random in order to provide further incentive to those participants who do not have high team score totals for a given week or for the overall contest.

Competition among remote participants is advantageously provided by the periodic disclosure of the leading scores in a publication 140 such as the newspaper 145, shown in FIG. 1. Preferably, this disclosure occurs soon after the distribution of the relevant statistics. Participants are thereby permitted to evaluate their position in the contest throughout the course of the contest through the publication.

As each participant is desirous of maximizing, or optimizing the team roster total for each discrete period, and/or the entire contest, as measured by the player score, there is an incentive to trade or exchange players between the team roster and the Contest Roster 110. This is because, while a given player may start off the season very well, that player may become injured or fall into a slump for a while. To maximize or optimize the team roster total, a participant exchanges players between his team roster and the Contest Roster 110. The timing, number and availability of these trades may be dictated pursuant to the specific sport, and/or the selected statistics. For example, in the preferred embodiment of the baseball contest, pitchers may be traded only once a week while all other players may be traded as often as the participant wants. Once a trade is made, it is effective starting the following day.

Throughout each discrete contest period, the interactive sports contest permits each participant to optimize the scoring potential of the individual team roster through an exchange of players between the participant's team roster and the Contest Roster 110. As indicated previously, the same player may be selected by more than one participant and thus a given player could conceivably be included as a member of all of the team rosters.

Publications

Preferably, a list of the athletes in the Contest Roster, daily statistics for each player in the roster, the rules, the contest system telephone numbers, and the formula used in the player score calculation are accessible to participants in some form of publication 140, such as radio broadcast, television broadcast, point of sale display or a printed publication such as a newspaper. In the preferred embodiment a daily newspaper 145 is used, and the newspaper 145 includes an access code which is unique to each publication cycle. This published access code must be used by the participant when accessing the interactive game system, and a new access code is preferably published on a daily basis. Advantageously, the access code is generated within the central controller 100 using a conventional random number generator in the central computer 200 such as is commonly found in most digital computers. Publication of the access code daily encourages participants to read the publication 140 regularly.

After a participant enters the contest, the central controller 100 allows access only upon entry of the most recent or current access code. The sports section of the newspaper 145 is often the most appropriate location for this information. The established distribution of the newspaper 145 provides for widespread distribution and ready availability to all participants. Of course the access code could be provided through other media including radio, television, or point of sale, for example.

Advantageously, in the preferred embodiment of the present invention, the publication 140 also periodically includes lists of the top performers. These lists would advantageously include those participant's whose teams have the highest point totals both for a given week and for the season cumulative as of the end of the previous week. The names and point totals of each of the top scoring participants may be included in the lists. When all the scores have been tabulated in each team roster for the past week, and for the season cumulative up to and including the past week, a listing of the top scores may then be printed out. The top team score lists may then be published later that week.

Rules and information about the interactive game system may also be published periodically in the publication 140.

After a participant has obtained a copy of a list of the players in the Contest Roster 110 along with their 4 digit codes, the participant selects the players to be on the team roster. The selection may be based upon a number of factors such as: (1) a careful review and analysis of the past performance cf each player on the Contest Roster 110 with knowledge of how the player score is calculated; (2) a prediction as to the anticipated performance of a player; (3) anticipated effects of game scheduling, such as may result from home field advantage, or a series of several games in a row which may result in player fatigue; and/or (4) a personal bias in favor of a player.

Because the factors which are likely to affect the performance of a given athlete are generally better evaluated by those participants who are familiar with the particular sport associated with the contest, those participants who are knowledgeable in the associated sport are more likely to choose rosters which generate high team scores. In this way, a certain skill factor is involved which gives those participants who are knowledgeable in the sport associated with the contest an advantage in the competition.

Operation of the Interactive Sports Contest

In the preferred embodiment, the interactive sports contest employs a contest entry telephone number and a participant interacting or playing telephone number. The preferred embodiment advantageously is implemented using a combination of a 1-800 and 1-900 numbers, although the system could be implemented as two 1-900 numbers. Further, any telephone number providing for a subscription fee and subscriber code to limit participation to subscribers can be used to implement the present invention. Alternatively, the entire system could be conducted under a single 1-900 telephone number format which initially presents an option to enter the system, or to play, so that participants pay corresponding to the total amount of interaction with the game system.

A. Entering the Contest

Figure 3:
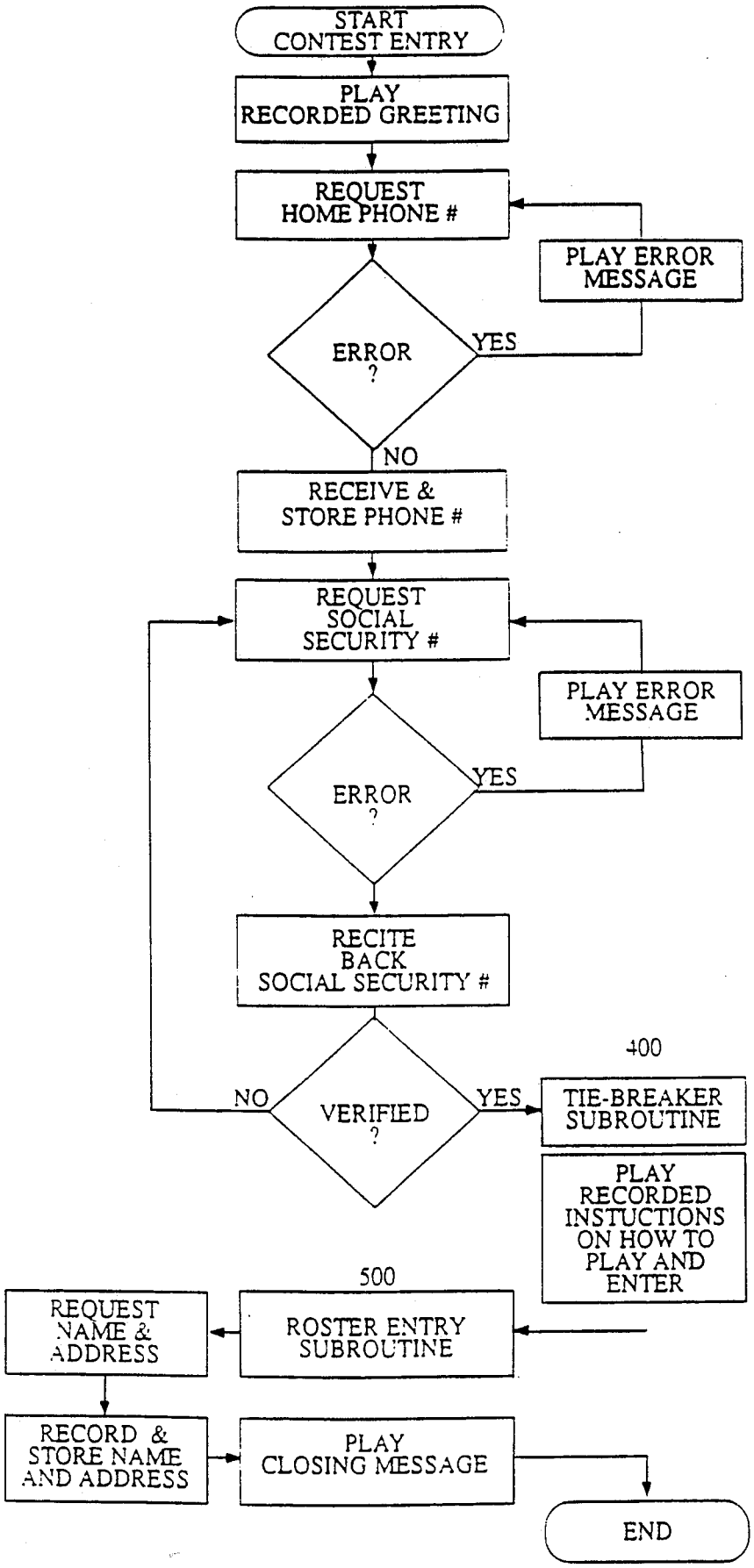
FIGS. 3–5 are flowcharts which diagram the sequence of interaction between the participant and the game system to be followed when entering the contest.

Advantageously, each participant initially contacts the interactive contest system through the contest entry telephone number. As illustrated in FIG. 3, upon dialing the contest entry telephone number, the central controller 100 provides a greeting and introduction to the interactive sports contest. The participant is then prompted to enter his 10-digit home telephone number, including area code, using the data entry terminal or key pad of the Touch-Tone TM telephone 102. As the participant depresses the keys corresponding to the digits of the telephone number, the machine recognizable signal, as produced by the Touch-Tone TM telephone 102, is transmitted through the data link 108 to the central controller 100. If there has been an error in transmission or in the number format (for example, a caller is not calling from a Touch-Tone TM telephone, or the telephone number is invalid) an error message will be played and the participant will be asked to try again. The central controller 100 then receives and stores the participant's telephone number. The participant is then prompted to enter his/her 9-digit social security number by means of the telephone key pad. Again, if there is an error, an error message is played and the participant is asked to try again. The computer 100 then recites the social security number to the participant so as to provide a verification of the information entered.

Figure 4:
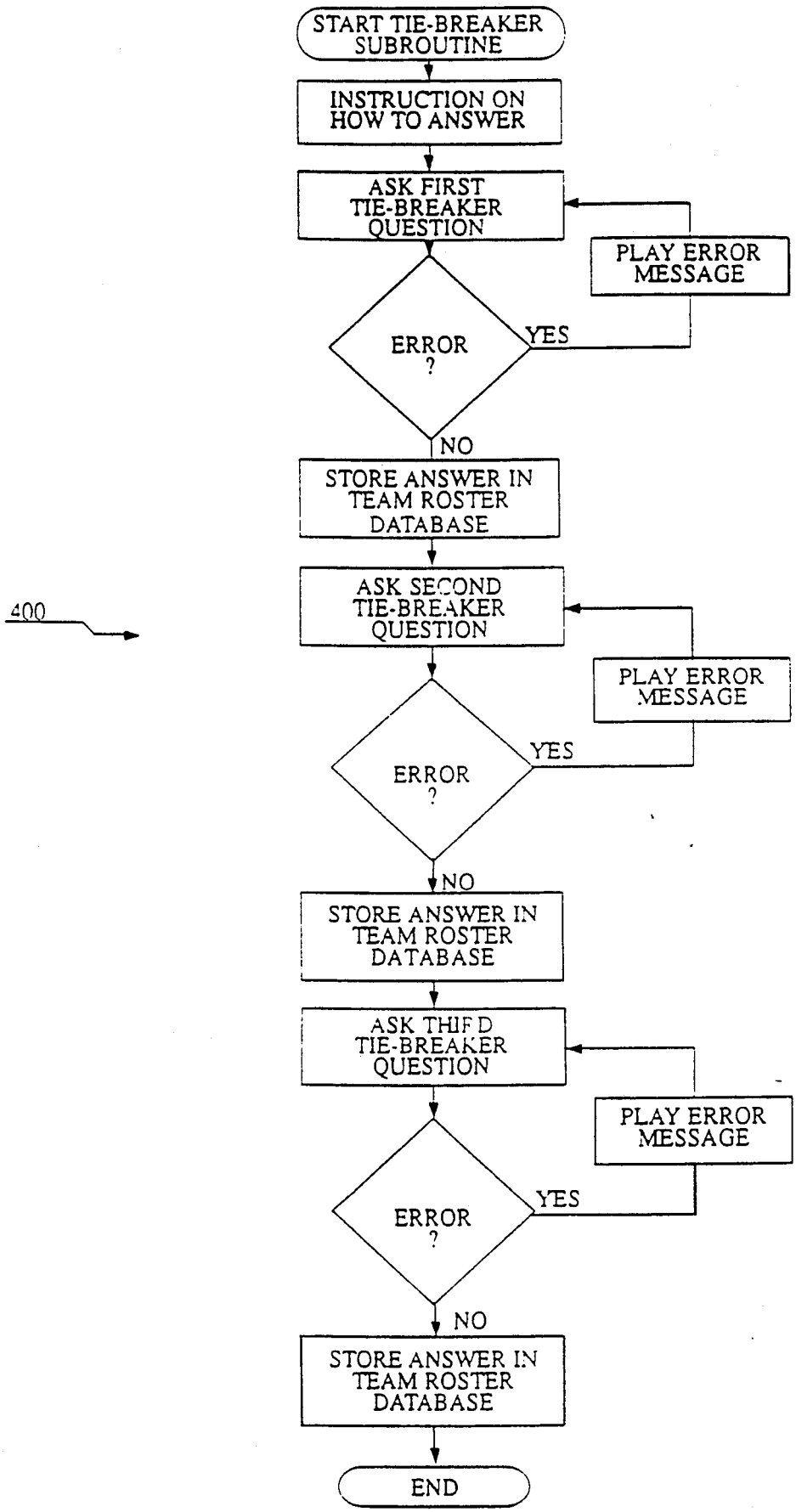

Once the computer receives a verification from the participant, the system then enters the tie-breaker subroutine 400 (further illustrated in FIG. 4), wherein the participant is asked to answer three tie-breaking questions. As illustrated in FIG. 4, the participant is asked to answer a first tie-breaker question. The participant's answer is then stored in the participant's team roster file. The participant is then asked to answer a second tie-breaker question. The answer is again stored in the individual's team roster file. Finally, the participant is asked a third tie-breaker question. This answer is also stored in the team roster file. Preferably, the tie-breaking questions require a numerical response which may be entered through the key pad of the telephone. If an error is detected at any point during the transmittal of information by the participant, an error message will be played and the participant will be requested to re-enter his selection.

In the preferred embodiment, the participant is asked how many home runs the home town team will hit in the season; how many runs the home town team will score during the season; and how many strike-outs the home town pitching staff will accumulate throughout the season. The tie-breaking questions are necessary because it is possible, although unlikely, that some participants will coincidentally select identical team rosters and perform identical trades throughout the competition thereby achieving identical scores. Though possible, it is also unlikely that participants who do not make identical trades during the season will accumulate identical scores by chance.

Figure 5:
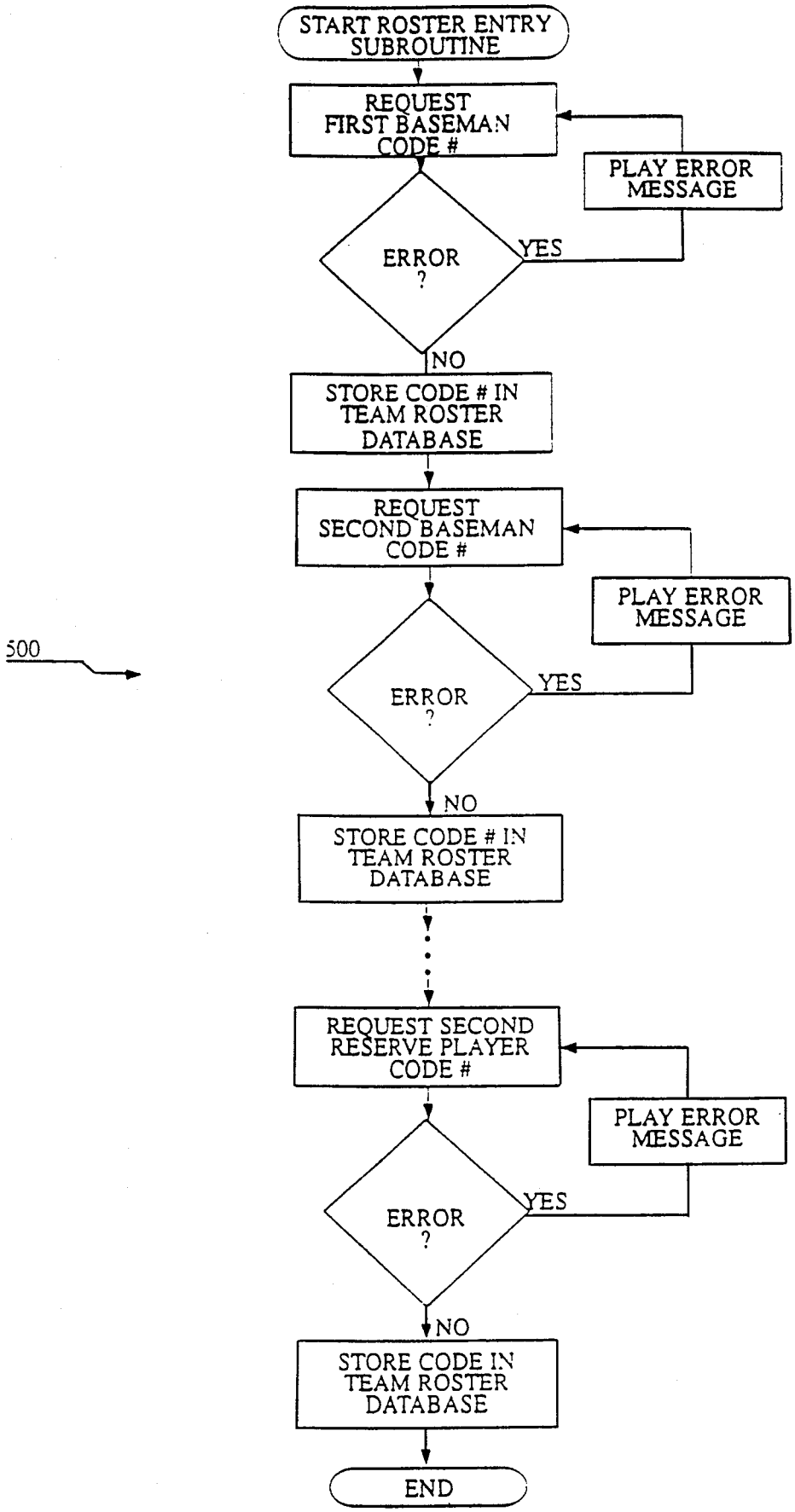

Next, the participant is instructed on how to enter a team roster for the interactive contest. The system then enters the team roster entry subroutine 500 as illustrated in detail in FIG. 5. The participant is prompted to enter the code of each member of the Contest Roster 110 which the participant desires to be included on their team roster. If an error is detected at any point during the transmittal of information by the participant, an error message will be played and the participant will be requested to re-enter his selection. In the preferred embodiment of the interactive baseball contest, fifteen players are selected to comprise the team roster. The team roster includes one player from each regular position plus four pitchers, a designated hitter and two reserve players. As depicted in FIG. 5, a typical order of entry in the interactive baseball contest may be first base, second base, third base, shortstop, first outfielder, second outfielder, third outfielder, catcher, first pitcher, second pitcher, third pitcher, fourth pitcher, designated hitter, first reserve player and second reserve player. To avoid unnecessary repetition, FIG. 5 includes reference to only the first two and the last entries. The system then verifies the proper entry of the team roster and informs the participant of the acceptance of the team roster.

The contest system then prompts the participant to recite his/her name and address orally, which the system receives and stores in a manner well known in the art.

Finally, a closing message, which includes a message regarding how to modify a team roster and check team and individual player scores, is then recited to the participant.

B. Interaction

Figure 6:
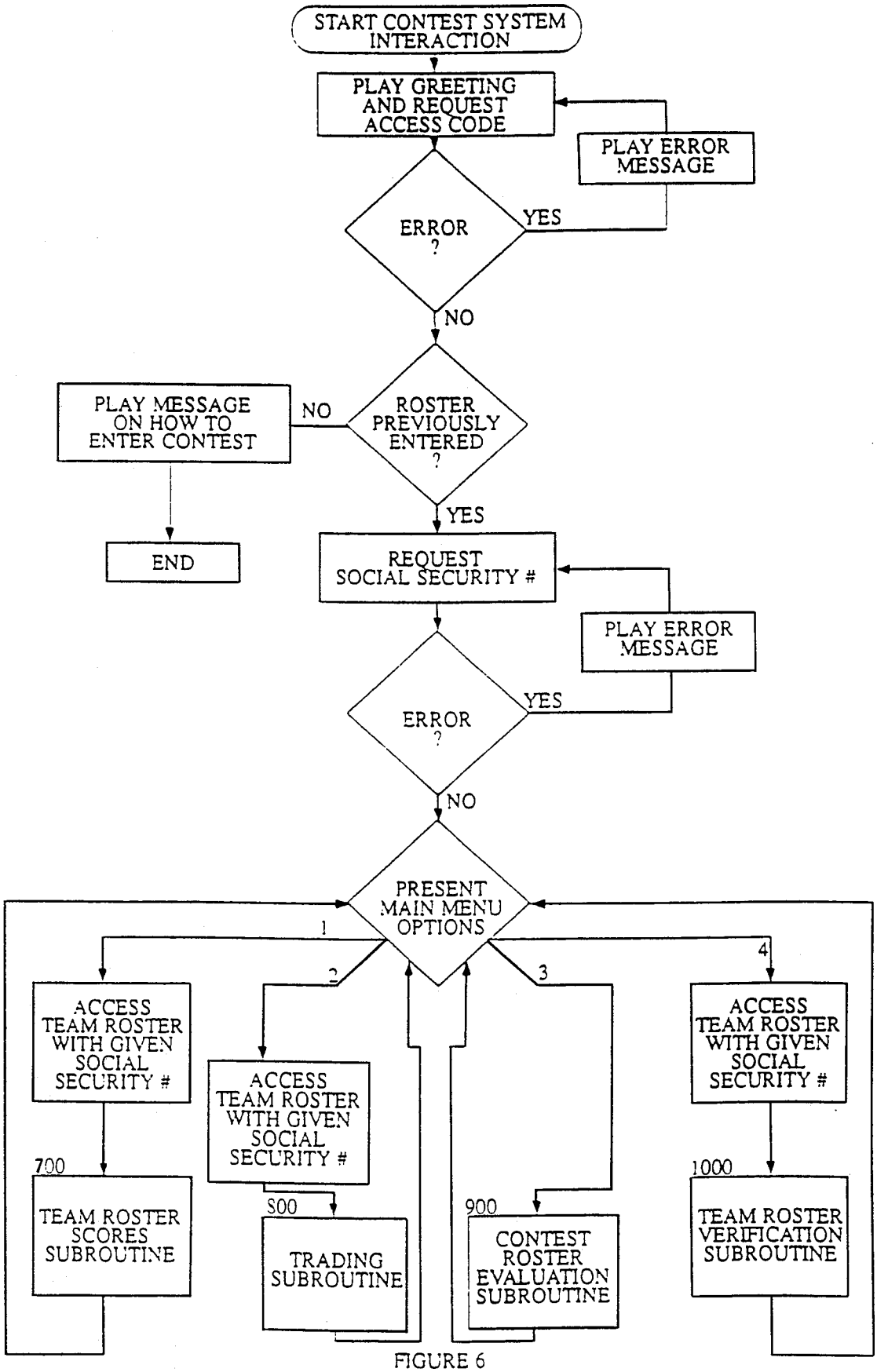
FIG. 6 is a flowchart which diagrams the sequence of interaction between the participant and the game system to be followed when interacting as a participant in the contest.

Preferably, the interactive phase of the contest is achieved through use of a contest playing telephone number. As illustrated in FIG. 6, upon accessing the central controller 100 through the contest playing telephone number, a greeting is recited to the participant. The participant is then prompted to enter the current access code, as obtained from the publication 145. Preferably, an exit is presented for players who have not entered a team roster, wherein the participant is recited the contest entry telephone number. Registered participants, those having a team roster, are requested to enter their social security number. If an error is detected, such as an invalid social security number, the participant is asked to key in his social security number again. A main menu of options is then recited to the participant, wherein each option corresponds to a number on the key pad of the telephone. The main menu options advantageously include: (1) team roster scores; (2) trading; (3) contest roster evaluation; and (4) team roster verification. A menu option is accessed by depressing the corresponding key of the telephone key pad when the main menu is presented to the participant. When main menu options 1, 2, or 4, are accessed, the central controller 100 first accesses the team roster associated with the given social security number. The system then enters the corresponding subroutine as depicted in FIG. 6. When main menu option number three is selected, the system enters the Contest Roster evaluation subroutine 900 directly. A participant may exit from the main menu by simply hanging up the Touch Tone TM phone 102.

1. Team Roster Scores

Figure 7:
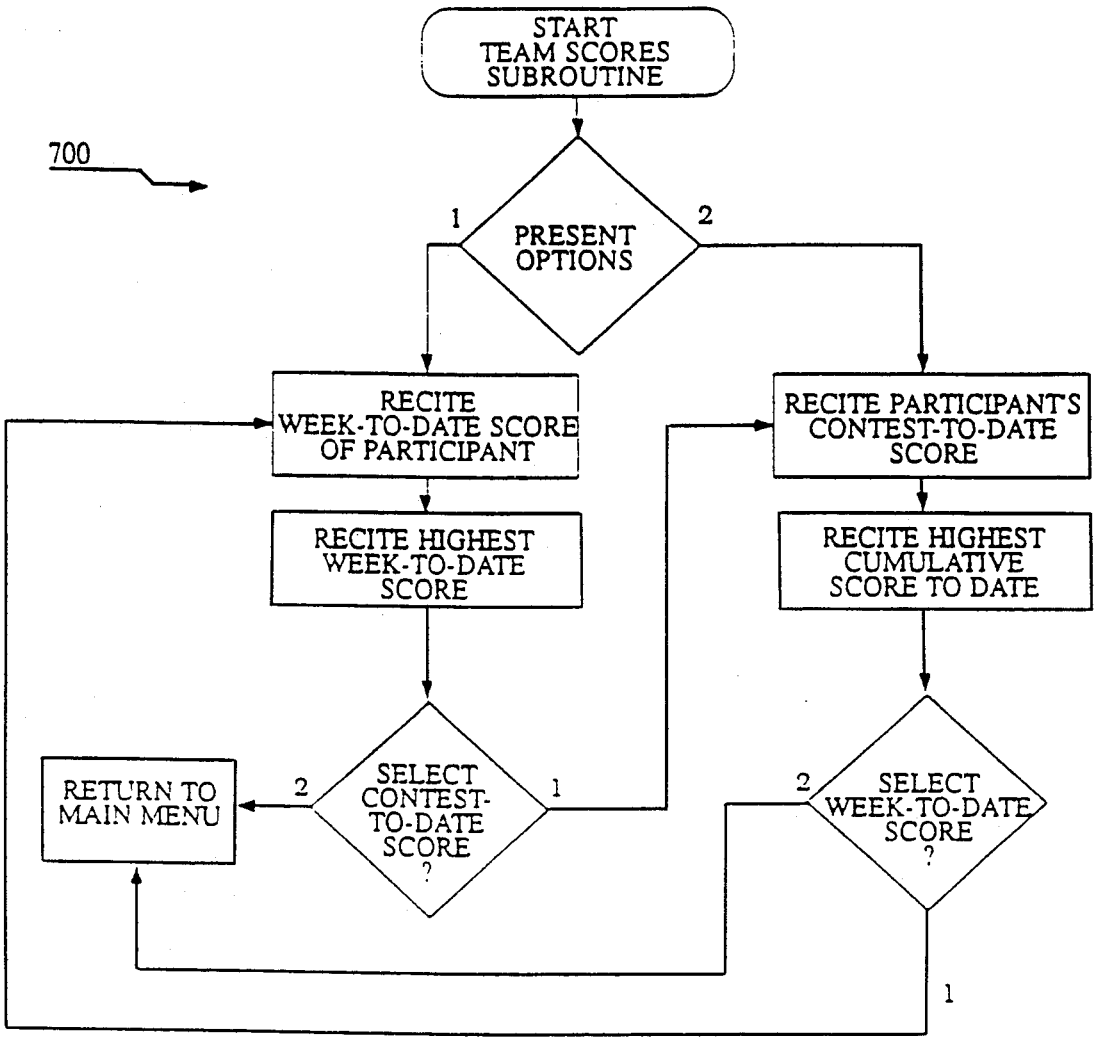
FIG. 7 is a flowchart which diagrams the sequence of interaction between the participant and the game system to be followed during the team roster scores subroutine of FIG. 6.

Upon pressing the number "1" on the telephone key pad, the participant enters the team roster scores subroutine 700. The team roster scores subroutine 700 is depicted in FIG. 6, and further illustrated in FIG. 7. Upon entering the team roster scores subroutine 700, the participant is presented with two options. The first option, selected by pressing "1" on the keypad, is the week-to-date score of the participant and the highest week-to-date score for the week. The second option, selected by pressing the number "2" on the keypad, is the contest-to-date score of the participant and the highest in the contest. If the participant selects the first option, the week-to-date score of the participant and the highest week-to-date score for that week are recited by the central controller 100 through data link 108 to be received on the data entry terminal 105. The participant may then either press "1" to hear the contest-to-date scores for the team roster and the highest team roster score, or alternatively may press "2" and return to the main menu.

Alternatively, if the participant had initially selected the contest-to-date scores, the participant is prompted with the option of either returning to the main menu or hearing the week-to-date scores.

2. Trading

Figure 8:
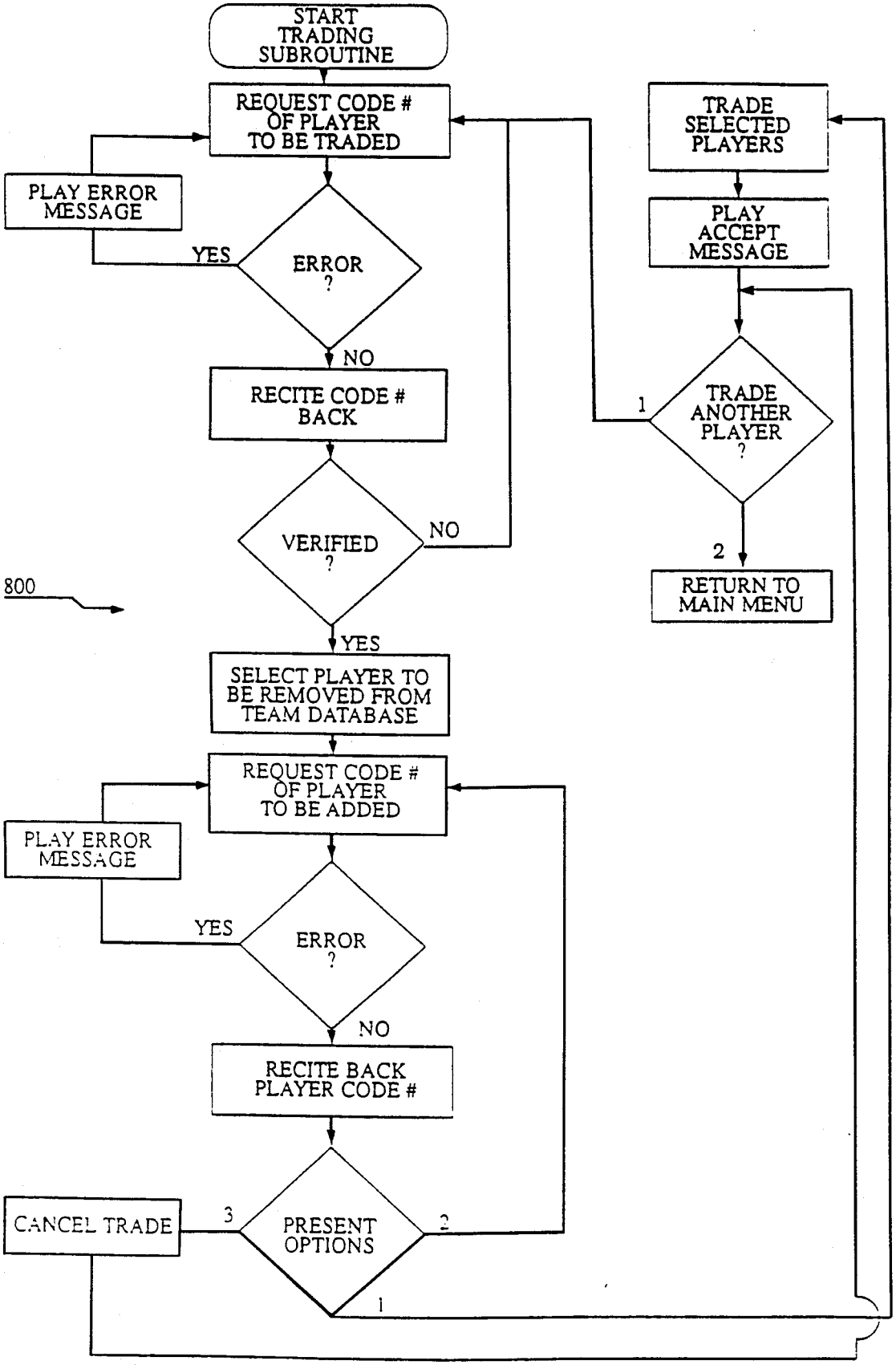
FIG. 8 illustrates the specifics of the sequence of interaction between the participant and the game system to be followed during the trading subroutine of FIG. 6.

Upon pressing "2" in the main menu, the participant enters the trading subroutine 800, as depicted in FIG. 6. In the trading subroutine 800, as further illustrated in FIG. 8, the participant is prompted to enter the code of the player to be dropped from their team roster. If an error is detected (for example, a code may be entered for a player who is not on the participant's team roster) an error message is played and the participant is asked to reenter the code of the athlete to be dropped. After the participant has keyed in the code of the player to be dropped, the central controller 100 then recites the code back to the participant so that the participant may verify proper entry of the code. Upon verification of the code, the player is selected to be dropped from the team roster. Note that the player selected to be dropped is not actually dropped until the trade is finalized.

The central controller 100 then prompts the participant to enter the code of a player to be added to the team roster. After the participant has keyed in the code of the player to be added, the central controller 100 verifies the availability of the player. If the player number is available, the central controller 100 recites the code to the participant so that the participant may verify entry of the desired code. If the player number is not available (e.g., is already on the participant's team roster or not in the Contest Roster) then the controller plays an error message and requests the participant to reenter the code of the player to be added. After verification of the code, the participant may elect to accept the trade, change the player to be added, or reject the trade in its entirety. After the participant accepts the trade, the player is added to the team roster for the following day's games. The participant may then trade another player or return to the main menu by pressing either "1" or "2," respectively.

3. Contest Roster Evaluation

Figure 9:
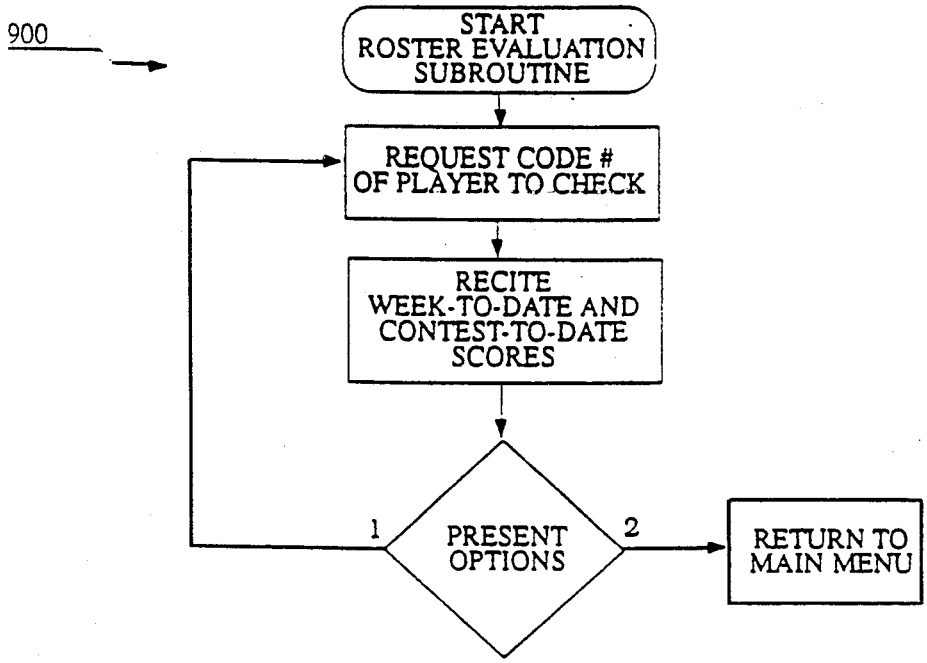
FIG. 9 illustrates the specifics of the sequence of interaction between the participant and the game system to be followed during the Contest Roster evaluation subroutine of FIG. 6.

Upon pressing "3" in the main menu, the participant enters the Contest Roster evaluation subroutine 900, as depicted in FIG. 6. Upon entering the Contest Roster evaluation subroutine 900, as further illustrated in FIG. 9, the participant is prompted to enter the code of a player on the Contest Roster 110 whose points the participant desires to check. The central controller 100 then recites the week-to-date points and the contest-to-date points of that player, whereupon the participant may either select another player or return to the main menu by pressing "1" or "2," respectively.

4. Team Roster Verification

Upon pressing "4" in the main menu, the team roster verification subroutine 1000 is entered, as depicted in FIG. 6. Upon entering the team roster verification subroutine 1000, further illustrated in FIG. 10, the central controller 100 recites the 4 digit numerical codes for each player, by position, of the current team roster, whereupon the participant may have the recital repeated or return to the main menu by pressing "1" or "2,"respectively.

EXAMPLE OF SCRIPT

An example of a pre-recorded script such as may be employed in the system of the preferred embodiment of the present invention is presented below. The script, such as presented herein, may be read over the telephone to the participant as a synthesized human voice. Preferably, those parts of the script which are repeated for every caller are synthesized as a tape recording. However, any appropriate form of play back may be used including digital compact optical discs or magnetic discs. Preferably, those parts of the script where there is a blank, indicating a space where a number (i.e., social security, player code, player point total, etc.) is to be read, are implemented with a conventional voice synthesizer.

Two script lists are presented below, one script list for the entry (sign-up) call, and one script list for the playing call. The script lists present the messages read to the participant in approximately the order the participant would hear the messages. Note that not all the messages presented on the script list are necessarily read to the participant, since some messages represent information read to the participant as the result of the selection of one option (i.e., trade player option), or as a result of some error (i.e. invalid access code error). The sample scripts read as follows:

DUGOUT DERBY SCRIPT LIST: ENTRY CALL

©Copyright 1989 Wakeman & de Forrest
All Rights Reserved

PRMT 001: (baseball organ music up and under): Hello, and thanks for calling to enter DUGOUT DERBY™ - the game that gives you a chance to manage your own big league baseball team, with some big league prizes!

In order to play, you MUST complete this call in its entirety - that's when the ump will tell you to "play ball." You'll need your social security number and official line-up card complete with 4-digit player codes. If you do not have these handy, please hang up and call again later.

PRMT 002: Using the buttons on your Touch-Tone™ phone, please enter your area code and home telephone number now.

PRMT 003: We're sorry, that's an invalid telephone number. Please enter it again now.

PRMT 004: We're sorry, you must be calling from a Touch-Tone™ telephone in order to participate.

PRMT 005: Thank you. Your social security number will act as your personal identification number during the contest. Using the buttons on your phone, please enter your nine-digit social security number now.

PRMT 006: We're sorry. You've entered an invalid social security number. Please check your number and enter it again now.

PRMT 007: The social security number you have entered is *  ****. [Repeat social security number back to participant]

PRMT 008: If that number is correct, press 1. If it is incorrect, press 3. Please enter your selection now.

PRMT 09: Our computer shows you have already entered a team. Only one team is allowed per player. If you have any questions, call our Customer Service Center at 1-800-*-**. Good-bye.

PRMT 010: In the case of a tie for grand prize, we ask that you answer the following three tie-breaking questions. To answer, you must enter a three-digit number. For example, if you think the answer is nine, enter 0 0 9. If you think the answer is ninety, enter 0 9 0. Or, if you think the answer is nine hundred, enter 9 0 0. First question. How many home runs will the [Home Team] hit during the season? Enter your selection now.

PRMT 011: Second question. How many runs will the [Home Team] score during the season? Enter your selection now.

PRMT 012: Third question. How many strikeouts will the [Home Team's] pitchers have during the season. Enter your selection now.

PRMT 013: Thank you. Now please tell us your full name at the tone. Please be sure to spell your last name. (Tone).

PRMT 014: Thank you. Please tell us your full mailing address including the city, state and zip code. Be sure to spell any words that may be difficult to understand. (Tone).

PRMT 015: Now it's time to select the players on YOUR team. You'll be given a position and, when asked, enter the four-digit code of the player you would like to play that position. Remember, in order to register your team in the game, you must remain on this call for its entirety. . . or until the ump yells "Play Ball!"

PRMT 016: Ready? Here we go. Please enter the four-digit code of the player you would like as your first baseman now.

PRMT 017: Enter the four-digit code of your second baseman now.

PRMT 018: Enter your third baseman now.

PRMT 019: Enter the code of your shortstop now.

PRMT 020: Enter your first outfielder now.

PRMT 021: Enter your second outfielder now.

PRMT 022: Enter your third outfielder now.

PRMT 023: Enter your catcher now.

PRMT 024: Enter your first pitcher now.

PRMT 025: Enter your second pitcher now.

PRMT 026: Enter your third pitcher now.

PRMT 027: Enter your fourth pitcher now.

PRMT 028: Enter your designated hitter now.

PRMT 029: Enter your first reserve player now.

PRMT 030: Enter your second reserve player now.

PRMT 031: The player code you have entered is not for the correct position. Please listen to the question again.

PRMT 032: You have already chosen that player. Please listen to the question again.

PRMT 0033 (baseball organ music up and under): You are now a Big League Manager in Dugout Derby. If you have any questions about Dugout Derby that haven't been answered, or would like to enjoy 50% off your sponsoring newspaper delivery through the end of this contest in October, please call 1-800-*-**. Thanks for calling - this could be your first step to the Hall of Fame. (umpires yell) Play Ball!

DUGOUT DERBY SCRIPT LIST: PLAYING CALL

Hello, and thanks for calling the DUGOUT DERBY™ GAME. Using the buttons on your phone, please enter the three-digit access code printed in the sports section of today's sponsoring newspaper.

ERROR PROMPT #53 (NO ENTRY): We're sorry, you must be calling from a Touch-Tone™ telephone in order to participate.

ERROR PROMPT #52 (WRONG CODE): The access code changes daily. The proper code can be found in the Sports section of your sponsoring newspaper. If you do not have today's code, please hang up and call again later. If you are sure you have the proper code for today, enter it again now.

(caller enters number)

Thank you. If you have selected your team and have already entered yourself in the game, press 1. If not, press 2. Please make your selection now.

CALLER PRESSES 2:

In order to sign up, you will need the official DUGOUT

DERBY roster and your official line-up card complete with four-digit player codes. These are available in your sponsoring newspaper. Once you have these, call 1-800-*-** to select your team and enter yourself in the game.

CALLER PRESSES 1:

Thank you. To identify yourself, please enter your nine-digit social security number now.

ERROR PROMPT #7 (INVALID FORMAT): We're sorry. You've entered an invalid social security number. Please check your number and enter it again now.

ERROR PROMPT #59 (NO RECORD): The social security number you have entered is not in our system. If you have NOT entered yourself in the game, please refer to the Sports section in the your sponsoring newspaper for entry instructions. If you HAVE signed yourself up and are having a problem gaining access, call customer service at 1-800-*-**. If you think you might have entered your social security number incorrectly, please enter it again now.

ERROR PROMPT #82 (INVALID DATA BASE) "BLACKLISTED": We're sorry but, according to our records, the head of your household requested that we do not allow you to continue playing the game. If you think that there is an error in our records, please call customer service at 1-800-*-**.

CALLER ENTERS VALID SOCIAL SECURITY NUMBER.

Welcome to the MAIN MENU. After you complete any MAIN MENU selection, you will have an opportunity to return to this menu.

* To check your personal team score, press 1.

* To trade players, press 2.

* To hear the individual points of any contest player listed in the DUGOUT DERBY™ roster, press 3.

* To hear your current team line-up as of yesterday, press 4.

* Tc get 50% off on your sponsoring newspaper delivery, more information, or customer service, press 5.

Please make your selection now.

MAIN MENU SELECT 1:
For your week-to-date score as of yesterday, press 1. For your contest-to-date score as of yesterday, press 2. Please make your selection now.

CALLER PRESSES 1:
Your personal week-to-date score is ___ points. The highest recorded week-to-date score is __ points.

To hear your CONTEST-TO-DATE score as of yesterday, press 1. To return to the MAIN MENU, press 2. Or, simply hang up to end the call.

CALLER PRESSES 2:
Your personal contest-to-date score is __ points. The highest recorded contest-to-date score is __ points.

To hear your WEEK-TO-DATE score as of yesterday, press 1. To return to the MAIN MENU, press 2. Or, simply hang up to end the call.

MAIN MENU SELECT 2:
To trade players, you will need the four-digit code numbers of both the player you are dropping and the player you are adding. Remember, you can only trade by position. For example, if you DROP a catcher, you must ADD a catcher. And don't forget, you can only trade pitchers once a week. For your trade to be official, you must stay on the line until you are asked to either trade another player, or go back to the MAIN MENU.

Check your line-up card, and enter the four-digit code number of the player you wish to drop now.

ERROR PROMPT #67 (NOT IN ROSTER): We're sorry, we did not understand your entry. The number you have entered is either an invalid player code or represents a player that is not presently in your line-up. Please listen to the question again.

ERROR PROMPT #84 (ALREADY TRADED): We're sorry, but you have already traded that player away during this call. If you would like to end this call, hang up now. If you would like to trade another player, stay on the line.

ERROR PROMPT #83 (INVALID PITCHER TRADE): We're sorry, but our records show that you have already traded a pitcher once this week. Please refer to your sponsoring newspaper for the official rules. If you would like to end this call, hang up now. If you would like to trade another player, stay on the line.

CALLER ENTERS CORRECT CODE:

Thank you. The player number you are dropping is _____. Press 1 if this is correct or press 2 if this is incorrect.

(caller presses 1)

Using the Dugout Derby™ Contest Roster, enter the four-digit code number of the player you wish to add now.

ERROR PROMPT #72 (INVALID CODE): Sorry, there is no player with that code in the official Contest Roster. If you think you have entered the code incorrectly, please check the roster and enter the code again now.

ERROR PROMPT #071 (INVALID TO ADD): Sorry, the player you are trying to add is either already on your team or doesn't play in the same position as the player you dropped. Please check the number and listen to the question again.

CALLER ENTERS CORRECT CODE:

The player number you are adding is _____.
Press 1 if this is correct and you wish to make this trade official, press 2 if this is incorrect, or press 3 if you have changed your mind and don't want this trade to be official.

(caller presses 1)

Thank you. Your trade has been accepted and will be in effect for tomorrow's games. If you'd like to trade another player, press 1. If you'd like to go back to the MAIN MENU, press 2. Or, simply hang up to end this call.

MAIN MENU SELECT 3:
Please enter the four-digit code of the player whose individual points you would like to hear now.

The player you selected has a week-to-date total of ___ and a contest-to-date point total of ___.

If you'd like to hear the points of another player, press 1.
If you'd like to go back to the MAIN MENU, press 2.
Or, simply hang up to end this call.

MAIN MENU SELECT 4:
Any player trades made today will be reflected in your line-up tomorrow. Your line-up as of yesterday, used for games played today, is as follows:

First Base _____
Second Base _____
Third Base _____
Shortstop _____
First Outfielder _____
Second Outfielder _____
Third Outfielder _____
Catcher _____
First Pitcher _____
Second Pitcher _____
Third Pitcher _____
Fourth Pitcher _____
Designated Hitter _____
First Reserve Player _____
Second Reserve Player _____

If you'd like to hear your line-up again, press 1.
If you'd like to go back to the MAIN MENU, press 2.
Or, simply hang up to end this call.

MAIN MENU SELECT 5:
If you want to find out how to get the special Dugout Derby™ offer of 50% off on your sponsoring newspaper delivery through the end of this contest in October, if you have any questions about rules and how the contest works, or if you have encountered any difficulties or problems with the game, call our customer service number at 1-800-*-**.

Although the present invention has been described in terms of particular embodiments, it is not limited to these embodiments. Alternative embodiments and modifications which would still be encompassed by the invention may be made by those skilled in the art, particularly in light of the foregoing teachings. Alternative embodiments, modifications or equivalents may be included within the spirit and scope of the invention as defined by the claims.

We claim:

1. An apparatus for providing an interactive game competition among an unlimited number of participants, comprising:

(a) a central controller;

(b) a plurality of data entry terminals remote from the central controller and accessible by the participants;

(c) a data link linking the data entry terminals to the central controller;

(d) a data register having stored therein a predefined data base comprising a finite set of data values corresponding to specific elements wherein the data register is accessible to the central controller;

(e) a statistical database which includes a set of statistics corresponding to elements of the data register;

(f) an unlimited number of subset databases, each subset database selected by a participant and including a non-exclusive subset of elements of the data register, wherein any of said elements may be simultaneously included in an unlimited number of said subset databases; and (g) means for evaluating said subset databases on the basis of the statistical data base to provide a ranking of game participants.

2. The apparatus as defined in claim 1, wherein the data entry terminal is a telephone capable of producing machine recognizable signals and the central controller is capable of recognizing the signals produced by the data entry terminal.

3. The apparatus as defined in claim 1, further comprising a periodic publication which discloses information about the interactive game system to the participants.

4. The apparatus as defined in claim 3, wherein the data entry terminal is a telephone capable of producing machine recognizable signals.

5. The apparatus as defined in claim 3, wherein the publication is a printed publication.

6. The apparatus as defined in claim 5, wherein the printed publication is a newspaper.

7. The apparatus as defined in claim 3, wherein the publication is a broadcast.

8. The apparatus of claim 1, wherein the data values correspond to athletes who participate in a particular sport.

9. The apparatus of claim 8, wherein the particular sport is baseball.

10. The apparatus defined in claim 1, wherein said specific elements represent athletes and said subset databases represent team rosters of athletes selected by participants.

11. The apparatus as defined in claim 10, wherein the athletes participate in baseball.

* * * * *

UNITED STATES PATENT AND TRADEMARK OFFICE

CERTIFICATE OF CORRECTION

PATENT NO. : 5,263,723

DATED : November 23, 1993

INVENTOR(S) : Timothy R. PEARSON et al.

It is certified that error appears in the above-indentified patent and that said Letters Patent is hereby corrected as shown below:

Column 33, line 67, change "accessible" to --directly accessible--.

Signed and Sealed this

Twenty-third Day of January, 1996

*Attest:*

Bruce Lehman

BRUCE LEHMAN

*Attesting Officer*

*Commissioner of Patents and Trademarks*